US007207308B2

(12) United States Patent
Venhaus et al.

(10) Patent No.: US 7,207,308 B2
(45) Date of Patent: Apr. 24, 2007

(54) FILTERLESS CRANKCASE LUBRICATION SYSTEM FOR A VEHICLE

(75) Inventors: David A Venhaus, Glen Allen, VA (US); Robert A. Shama, Midlothian, VA (US); James M. Horvath, Midlothian, VA (US); Dewey P. Szemenyei, Chesterfield, VA (US); Richard J. Rohfritch, The Woodlands, TX (US); Danny Pridemore, Union, KY (US)

(73) Assignee: Afton Chemical Corporation, Richmond, VA (US)

( * ) Notice: Subject to any disclaimer, the term of this patent is extended or adjusted under 35 U.S.C. 154(b) by 110 days.

(21) Appl. No.: 10/850,884

(22) Filed: May 21, 2004

(65) Prior Publication Data

US 2005/0257767 A1 Nov. 24, 2005

(51) Int. Cl.
*F01M 1/00* (2006.01)

(52) U.S. Cl. ..... 123/196 R; 184/6.5

(58) Field of Classification Search ..... 123/196 R; 184/6.5, 6.6, 6.7, 6.8
See application file for complete search history.

(56) References Cited

U.S. PATENT DOCUMENTS 4,089,794 A 5/1978 Engel et al.
4,137,185 A 1/1979 Gardiner et al.
4,144,181 A 3/1979 Elliott et al.
4,146,489 A 3/1979 Stambaugh et al.
4,320,019 A 3/1982 Hayashi
4,340,689 A 7/1982 Joffrion
4,357,250 A 11/1982 Hayashi
4,382,007 A 5/1983 Chafetz et al.
4,670,515 A 6/1987 Olivier
4,863,623 A 9/1989 Nalesnik
4,948,842 A 8/1990 Olivier
5,075,383 A 12/1991 Migdal et al.
5,162,086 A 11/1992 Migdal et al.
5,384,371 A 1/1995 Caines et al.
5,523,008 A 6/1996 Boden et al.
5,556,923 A 9/1996 Caines et al.
5,744,429 A 4/1998 Chung et al.
5,932,525 A 8/1999 Ney et al.
6,107,257 A 8/2000 Valcho et al.
6,516,771 B1 2/2003 Brown
6,543,394 B2 4/2003 Tinney
6,777,378 B2 * 8/2004 Abraham et al. ..... 508/185

OTHER PUBLICATIONS

Vern Parker, 1941 Cadillac covertible sedan is a rare model, 2000, Motor Matters.*

* cited by examiner

*Primary Examiner*—Stephen K. Cronin
*Assistant Examiner*—Katrina B. Harris
(74) *Attorney, Agent, or Firm*—MH2 Technology Law Group

(57) ABSTRACT

A crankcase lubricating system and method for lubricating an engine of a motor vehicle. The crankcase lubricating system includes filterless lubricant circulation system, and a crankcase lubricant containing a fully formulated lubricating base oil meeting or exceeding ILSAC GF-4 or API CI-4 minimum performance standards for engine oils.

44 Claims, 2 Drawing Sheets

FILTERLESS CRANKCASE LUBRICATION SYSTEM FOR A VEHICLE

TECHNICAL FIELD

The disclosure is related to vehicles, operation of vehicles and methods for maintaining vehicles, and, in particular, the disclosure is related to filterless crankcase lubrication systems for vehicles.

BACKGROUND

Automobiles and other motor vehicles continue to evolve to provide vehicles that require less routine maintenance. For example, vehicle coolant systems no longer require annual flushing and replacement of the coolant. Air intake filters have extended life between replacements. Spark plugs are constructed with exotic materials and do not have to be changed for 50,000 to 100,000 miles.

One advantage of the extended maintenance cycle for various components of a vehicle is that less time is required for a vehicle to be in a shop for routine maintenance. For tractor-trailer rigs hauling goods long distance, routine maintenance is costly from the standpoint that revenue is generated by the number of miles driven. Another advantage of the improvements in motor vehicles with reduced maintenance is that the annual maintenance costs for such vehicles continue to decrease, or at least do not rise with the rising cost of goods and services.

Despite advances made in the reduction of routine maintenance, there continues to be a need for systems and methods for motor vehicles which reduce the routine maintenance costs of the vehicles. There is also a need for vehicles which have reduced design constraints.

SUMMARY OF THE DISCLOSURE

With regard to the foregoing, there is described herein a crankcase lubricating system and method for lubricating an engine of a motor vehicle. The crankcase lubricating system includes filterless lubricant circulation system, optionally, a lubricant circulation pump, and a crankcase lubricant containing a fully formulated lubricating oil meeting or exceeding ILSAC GF-4 or API CI-4 minimum performance standards for engine oils.

In another embodiment, there is provided a method of lubricating moving parts of a fuel combustion engine having separate fuel and lubricant systems. The method includes the steps of providing a crankcase lubricating system containing a lubricant circulation device. The crankcase lubricating system is devoid of a lubricant filter. A lubricant is circulated in the crankcase lubricating system. The lubricant meets or exceeding ILSAC GF-4 or API CI-4 standards for engine oils.

In yet another embodiment, there is provided a method for reducing maintenance costs for a motor vehicle. The method includes providing an engine and a crankcase lubricating system for the engine. An oil filter in an oil filter location for the crankcase lubricating system removed. A substantially permanent bypass device is attached to the oil filer location. A lubricant is circulated in the crankcase lubricating system. The lubricant meets or exceeds ILSAC GF-4 or API CI-4 minimum performance standards for engine oils.

An advantage of the apparatus and methods described herein is that maintenance costs for operating a vehicle are reduced. Another advantage is that engine designs do not need to accommodate access to a lubricant filter component.

Accordingly, space requirements for the lubricant filter and for removal of the filter from the engine are eliminated from the design of the engine.

BRIEF DESCRIPTION OF THE DRAWINGS

Further advantages of the embodiments described herein will become apparent by reference to the detailed description of preferred embodiments when considered in conjunction with the drawings, wherein like reference characters designate like or similar elements throughout the several drawings as follows.

DETAILED DESCRIPTION OF EMBODIMENTS OF THE DISCLOSURE

Figure 1:
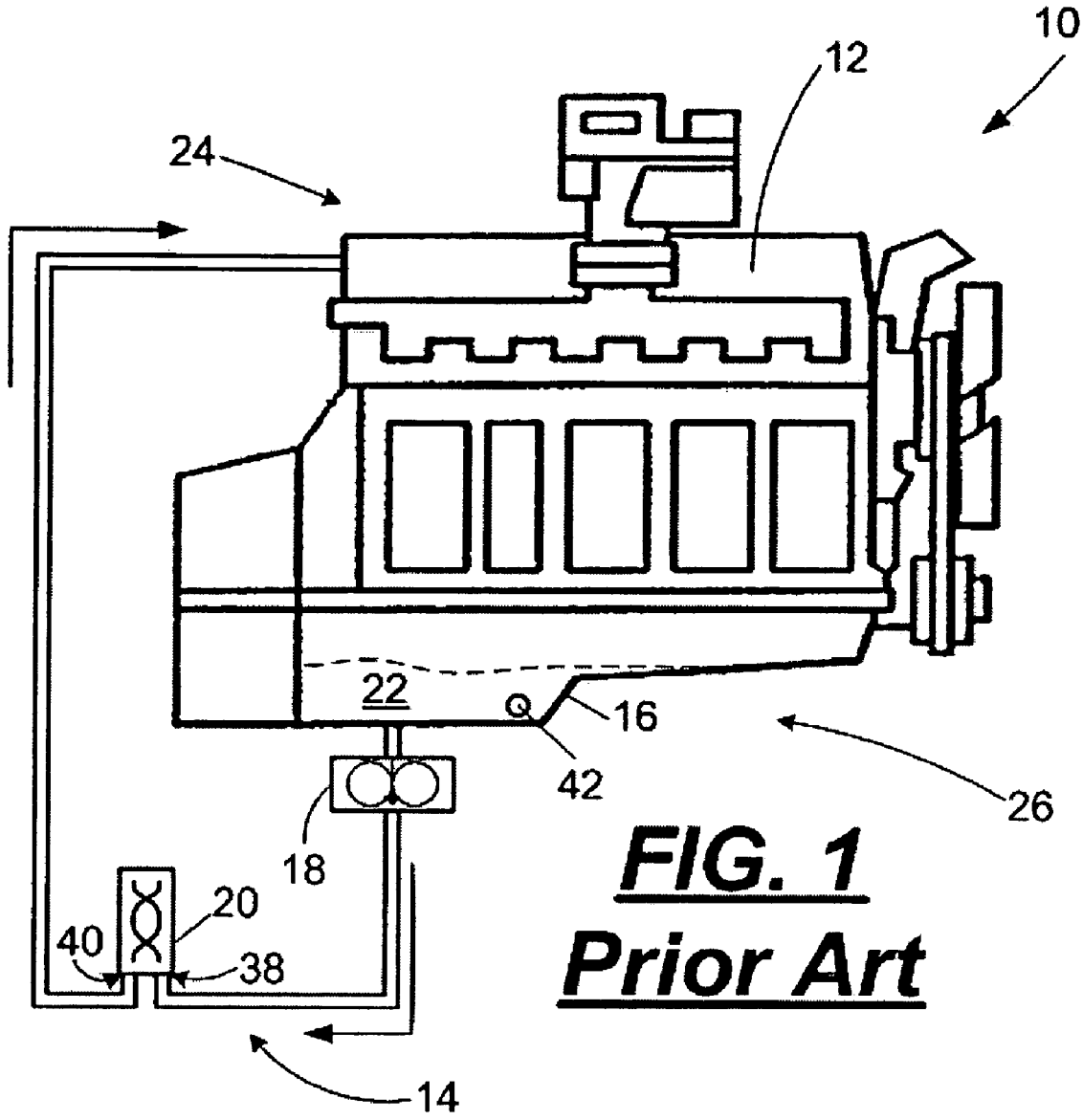
FIG. 1 Prior Art
FIG. 1 is a schematic drawing of a conventional crankcase lubrication system for an engine.

A conventional engine and crankcase lubrication system 10 are schematically illustrated in FIG. 1. The engine 12 may be any of the commonly used engines in vehicles and other fuel engine containing devices, including, but not limited to compression-ignition engines and spark-ignition engines. The engines 12 typically have separate fuel and lubrication systems. The lubrication system 14 includes an oil pan or oil sump 16, and, optionally, an oil circulation pump 18 or other device known in the art configured to circulate oil or lubricant to moving parts of the engine 12, and a lubricant filter 20. Lubricant 22 in the sump 16 is circulated to an upper portion 24 of the engine 14 so that the lubricant passes through the engine 14 to lubricant moving parts thereof such as the valve train, cylinders, crankshaft and the like. Such lubrication systems 14 may be internal or external to the engine 12.

In the conventional engine 12, the lubricant 22 is typically changed after a period of time due to accumulation of sludge and deposits in the lubricant 22. The filter 20 typically contains a porous web or other particulate removal device that traps harmful deposits that may increase engine wear and reduce engine performance. Accordingly, the oil filter is often changed each time the lubricant is changed.

For the purposes of the disclosure, the terms "filter" and "filter means," include, but are not limited to, removable and non-removable gauze, screen, foam, pad, by-pass filters, or other particulate removal devices. The term "filterless" means the substantial absence of a filter or filter means. The term "externally removable" means bolted, screwed or otherwise attached to an exterior portion of an engine or motor.

Oil filters 20 are available in a variety of sizes for different engine applications. In an automobile engine, the oil filter 20 must be located so as to be accessible for easy removal and replacement. Replaceable oil filters 20 require that accommodation be made for tools used to remove and replace the filter 20. Accordingly, one limitation of engine design relates to providing easy access to the filter 20 for routine maintenance. Typically, the filter 20 is located on a lower portion 26 of the engine 12 for more effective filtering of sludge and deposits.

Figure 2:
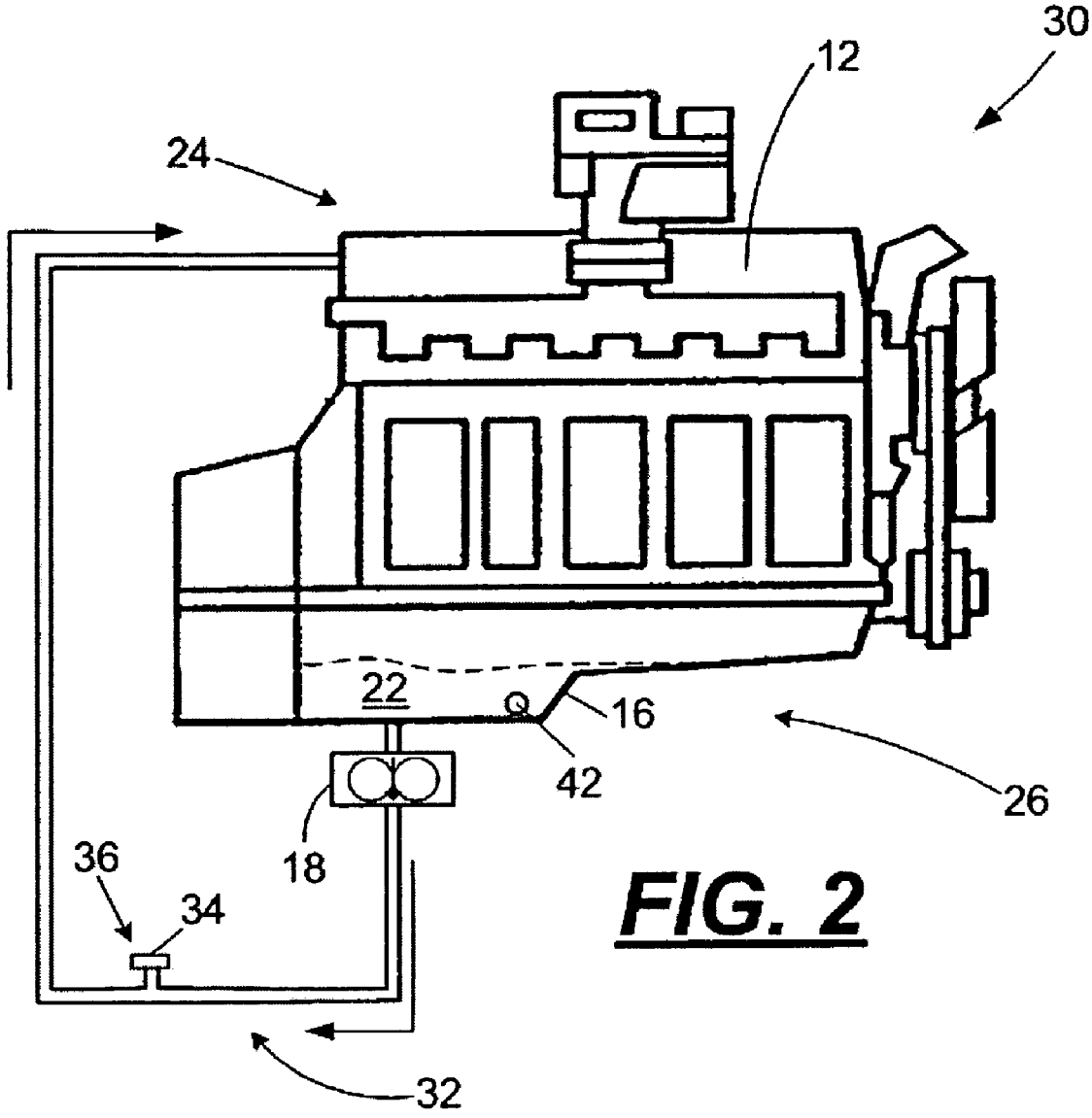
FIG. 2 is a schematic drawing of a crankcase lubrication system according to the disclosure.

FIG. 2 schematically illustrates an engine and crankcase lubrication system 30 according to the disclosure. The system 30 illustrated in FIG. 2 is a radical departure from conventional technology. In this system 30 a crankcase lubricant circulation system 32 is provided having a substantial absence of a removable filter means. In place of the filter 20 (FIG. 1), the system 32 includes a bypass device 34 for replacing a filter in a filter location 36 so that a closed lubricant circulation system 32 is provided. The bypass device 34 contains passages therein for connecting a filter inlet port 38 to a filter exit port 40 (FIG. 1). In an alternative embodiment, an engine 12 is designed without an external filter 20 location. Accordingly, plug 34 is also eliminated. In the filterless embodiments, the lubricant 22 remains in the engine 12 until it is replaced by draining the lubricant through, for example, a drain plug 42 in the sump 16.

While the foregoing embodiment contemplates a filterless crankcase lubrication system, it will be appreciated that various internal or substantially non-replaceable filter devices may also be included in the engine 12. Such internal or substantially non-replaceable devices include, but are not limited to, wire mesh screening devices, perforated plate screening devices, and the like.

An important component of the filterless lubrication system 32 for motor vehicles as described above is a lubricant that is formulated to meet or exceed GF-4 standards as set by the International Lubricant Standardization and Approval Committee (ILSAC) for spark ignition engines. The GF-4 requirements are as follows:

1. Fresh Oil Viscosity Requirements:
   1a. Lubricants shall meet all of the requirements of SAE J300 for viscosity grades of SAE 0W, 5W, 10W and multigrade oils.
   1b. Lubricants shall have a gellation index maximum of 12 according to ASTM D 5133.
2. Engine Test Requirements:
   2a. Wear and Oil Thickening: ASTM Sequence IIIG Test

| | |
|---|---|
| Kinematic viscosity increase at 40° C. | 150% maximum |
| Averaged weighted piston deposits (merits) | 3.5 minimum |
| Hot stuck rings | none |
| Average cam plus lifter wear (μm) | 60 maximum |

2b. Aged Oil Low Temperature Viscosity: ASTM Sequence IIIGA Test

The D 4684 viscosity of the EOT lubricant sample must meet the requirements of the original grade or the next higher grade.

2c. Wear, Sludge and Varnish Test: Sequence VG, ASTM 6593

| | |
|---|---|
| Average engine sludge (merits) | 7.8 minimum |
| Average rocker cover sludge (merits) | 8.0 minimum |
| Average engine varnish (merits) | 8.9 minimum |
| Average piston skirt varnish (merits) | 7.5 minimum |
| Oil screen sludge (% area) | 20 maximum |
| Oil screen debris (% area) | rate and report |
| Hot stuck compression rings | none |
| Cold stuck rings | rate and report |
| Oil ring clogging (% area) | rate and report |
| Follower pin wear, cyl #8, avg. (avg. μm) | rate and report |
| Ring gap increase, cyl #1 & #8, (avg. μm) | rate and report |

2d. Valve train Wear: Sequence IVA, ASTM D 6891

Average cam wear (7 position average, μm) 90 maximum

2e. Bearing Corrosion: Sequence VIII, ASTM D 6709

Bearing weight loss (mg) 26 maximum

2f. Fuel Efficiency: Sequence VIB, ASTM D 6837

SAE 0W-20 and 5W-20 viscosity grades:

2.3% FEI 1 minimum after 16 hours aging 2.0% FEI 2 minimum after 96 hours aging

SAE 0W-30 and 5W-30 viscosity grades:

1.8% FEI 1 minimum after 16 hours aging 1.5% FEI 2 minimum after 96 hours aging

SAE 10W-30 and all other viscosity grades not listed above:

1.1% FEI 1 minimum after 16 hours aging 0.8% FEI 2 minimum after 96 hours aging

3. Bench Test Requirements:

3a. Catalyst Compatibility:

| | |
|---|---|
| Phosphorus content (ASTM D 4951) | 0.08% (mass) maximum |
| Sulfur content (ASTM D 4951 or D2622) | |
| SAE 0W and 5W multigrades | 0.5% (mass) maximum |
| SAE 10W multigrades | 0.7% (mass) maximum |

3b. Wear

Phosphorus content (ASTM D 4951) 0.06% (mass) minimum

3c. Volatility

| | |
|---|---|
| Evaporation Loss (ASTM D 5800) | 15% maximum, 1 h at 250° C. |
| Simulated distillation (ASTM D 6417) | 10% maximum at 371° C. |

3d. High Temperature Deposits, TEOST MHT

Deposit weight (mg) 35 maximum

3e. Filterability

| EOWTT (ASTM D 6794) | |
|---|---|
| With 0.6% $H_2O$ | 50% maximum flow reduction |
| With 1.0% $H_2O$ | 50% maximum flow reduction |
| With 2.0% $H_2O$ | 50% maximum flow reduction |
| With 3.0% $H_2O$ | 50% maximum flow reduction |
| EOFT (ASTM D 6795) | 50% maximum flow reduction |

3f. Foaming Characteristics, ASTM D 892 (Option A)

| | Tendency | Stability |
|---|---|---|
| Sequence I | 10 mL maximum | 0 mL maximum |
| Sequence II | 50 mL maximum | 0 mL maximum |
| Sequence III | 10 mL maximum | 0 mL maximum |

3g. High Temperature Foaming Characteristics, ASTM D 6082 (Option A)

| Tendency | Stability |
|---|---|
| 100 mL maximum | 0 mL maximum |

3h. Shear Stability, Sequence VIII, ASTM D 6709

| | |
|---|---|
| 10-hour stripped KV at 100° C. | Kinematic viscosity must remain in original SAE viscosity grade. |

3i. Homogeneity and Miscibility, ASTM D 6922

Shall remain homogeneous and, when mixed with SAE reference oils, shall remain miscible.

3j. Engine Rusting, Ball Rust Test. ASTM D 6557

Average gray value 100 minimum

For compression-ignition engines, such as diesel engines, the lubricant is formulated to meet or exceed API CI-4 standards. The API CI-4 requirements are as follows:

1. Laboratory Testes for Oil Meeting API CI-4

1.1 Viscosity Grades—Lubricants shall meet all of the requirements of SAE J300 for viscosity grades of SAE 0W, 5W, 10W and multigrade oils.

1.2 High Temperature Corrosion Bench Test (ASTM D 6594)

| | |
|---|---|
| Copper increase, max (ppm) | 20 |
| Lead increase, max (ppm) | 120 |
| Tin increase, max (ppm) | 50 |
| Copper strip rating, max (D130) | 3 |

1.3 Foam Test (ASTM D 892) (Option A not Allowed)

| Foaming/Settling, max | |
|---|---|
| Sequence I (mL) | 10/0 |
| Sequence II (mL) | 20/0 |
| Sequence III (mL) | 10/0 |

1.4 Shear Stability (ASTM D 6278)

| | |
|---|---|
| After shear viscosity, 10W-30, min (cSt) | 9.3 |
| After shear viscosity, 15W-40, min (cSt) | 12.5 |

1.5 Volatility (ASTM D 5800)(Noack)

Evaporative loss at 250° C., max (%) 15

1.6 High Temperature/High Shear

As allowed in SAE J300 Viscosity, min (mPa-s) 3.5

1.7 Low Temperature Pumpability (ASTM D 4684)(MRV TP-1)

Viscosity of 75 h used oil sample from T-10 Test at −20° C., max (mPa-s) 25000

Modified D4684 (if yield stress)

Viscosity at −20° C., max Yield stress, max (mPa-s/Pa) 25000/35

1.8 Elastomer Compatibility Limits

| | Volume Change | Hardness | Tensile Strength | Elongation |
|---|---|---|---|---|
| Nitrile | +5/−3 | +7/−5 | +10/−TMC1006 | +10/−TMC1006 |
| Silicone | +TMC1006/−3 | +5/−TMC1006 | +10/−45 | +20/−30 |
| Polyacrylate | +5/−3 | +8/−5 | +18/−15 | +10/−35 |
| FKM | +5/−2 | +7/−5 | +10/−TMC1006 | +10/−TMC1006 |

2. Engine Tests for Oil Meeting API CI-4

2.1 Mack T-8E (ASTM D 5967)

Relative Viscosity at 4.8% soot/max/new oil 1.8 1.9 2.0

2.2 Mack T-10 Test with EGR

Merit Rating, min 1000 1000 1000

2.3 Cummins M11-EGR High Soot Test

| | | | |
|---|---|---|---|
| Crosshead Weight loss, max (mg) | 20.0 | 21.8 | 22.6 |
| Top ring weight loss, max (mg) | 175 | 186 | 191 |
| Filter delta pressure at 250 h, max (kPa) | 275 | 320 | 341 |
| Sludge rating, min (merits) | 7.8 | 7.6 | 7.5 |

2.4 Caterpillar 1R Piston Deposit Test

| | | | |
|---|---|---|---|
| WDR, max (demerits) | 382 | 396 | 402 |
| TGC, max (demerits) | 52 | 57 | 59 |
| TLC, max (demerits) | 31 | 35 | 36 |
| Initial Oil Consumption, max (g/h) | 13.1 | 13.1 | 13.1 |
| Final Oil Consumption, max (g/h) | IOC + 1.8 | IOC + 1.8 | IOC + 1.8 |
| Piston ring and liner scuffing | None | None | None |
| Ring Sticking | None | None | None |

2.5 Caterpillar 1K (ASTM RR: D02-1273)

| | | | |
|---|---|---|---|
| Weighted Piston Deposits, max (demerits) | 332 | 347 | 353 |
| Top Groove Fill, max (%) | 24 | 27 | 29 |
| Top Land Heavy Carbon, max (%) | 4 | 5 | 5 |
| Oil Consumption (0–252 h), max (g/kW-h) | 0.5 | 0.5 | 0.5 |
| Piston ring and liner scuffing | None | None | None |

or

Caterpillar 1N (ASTM RR: D02-1321)

| | | | |
|---|---|---|---|
| Weighted Piston Deposits, max (demerits) | 286.2 | 311.7 | 323.0 |
| Top Groove Fill, max (%) | 20 | 23 | 25 |
| Top Land Heavy Carbon, max (%) | 3 | 4 | 5 |
| Oil Consumption (0–252 h), max (g/kW-h) | 0.5 | 0.5 | 0.5 |
| Piston ring and liner scuffing | None | None | None |
| Ring Sticking | None | None | None |

2.6 Roller Follower Wear Test (ASTM D 5966)

Average Pin Wear, max (μm)/(mils) 7.6/(0.30) 8.4/(0.33) 9.1/(0.36)

2.7 Engine Oil Aeration Test (ASTM RR:D02-1379)

Aeration, max (Vol %) 8.0

2.8 Sequence IIIF (ASTM RR:D02-1491)

Viscosity increase at 80 h, max (%) 275

Lubricants provided according to the foregoing GF-4 or API CI-4 standards include a base oil and an oil additive package to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

Natural oils include animal oils and vegetable oils (e.g., castor, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The synthetic lubricating oils used in this invention include one of any number of commonly used synthetic hydrocarbon oils, which include, but are not limited to, poly-alpha-olefins, alkylated aromatics, alkylene oxide polymers, interpolymers, copolymers and derivatives thereof here the terminal hydroxyl groups have been modified by esterification, etherification etc, esters of dicarboxylic acids and silicon-based oils.

Fully formulated lubricants conventionally contain an additive package that will supply the characteristics that are required in the formulations. Among the types of additives included in the additive package are viscosity index improvers, antioxidants, corrosion inhibitors, detergents, dispersants, pour point depressants, antiwear agents, antifoamants, demulsifiers and friction modifiers.

One particularly useful component of the additive package for use in a lubricating system for a filterless engine as described above is a nitrogen containing olefin copolymer derived from a copolymer having grafted thereon from about 0.15 to about 1.0 carboxylic groups per 1000 number average molecular weight units of the copolymer. The carboxylic groups are subsequently reacted with amines to provide the nitrogen containing olefin copolymers. The olefin copolymer may have a number average molecular weight ranging from about 20,000 to about 100,000.

Another nitrogen containing olefin copolymer for use in an additive package for a crankcase lubricant includes an olefin copolymer derived from a copolymer having grafted thereon from about 0.25 to about 0.5 carboxylic groups per 1000 number average molecular weight units of the copolymer. In this case, the copolymer may have a number average molecular weight ranging from about 40,000 to about 80,000.

Nitrogen containing olefin copolymers as set forth above are described, for example, in U.S. Pat. No. 4,089,794 to Engel et al., U.S. Pat. No. 4,137,185 to Gardiner et al., U.S. Pat. No. 4,146,489 to Stambaugh et al., U.S. Pat. No. 4,320,019 to Hayashi, U.S. Pat. No. 4,357,250 to Hayashi, U.S. Pat. No. 4,382,007 to Chafetz et al., U.S. Pat. No. 4,144,181 to Elliott et al., U.S. Pat. No. 4,863,623 to Nalesnik, U.S. Pat. No. 5,075,383 to Migdal et al., U.S. Pat. No. 5,556,923 to Caines et al., U.S. Pat. No. 5,932,525 to Ney et al., U.S. Pat. No. 5,162,086 to Migdal et al., and U.S. Pat. No. 5,744,429 to Chung et al. A particularly useful nitrogen containing olefin copolymer is described in U.S. Pat. No. 6,107,257 to Valcho et al.

The terms polymer and copolymer are used generically to encompass ethylene copolymers, terpolymers or interpolymers. Such materials may contain minor amounts of other olefinic monomers so long as the basic characteristics of the ethylene copolymers are not materially changed.

The polymer or copolymer backbone of the additive is a highly grafted, multi-functional olefin copolymer prepared from ethylene and propylene or it may be prepared from ethylene and at least one higher olefin within the range of $C_3$ to $C_{23}$ alpha-olefins. Copolymers of ethylene and propylene are most preferred. Other alpha-olefins suitable in place of propylene to form the copolymer or to be used in combination with ethylene and propylene to form a terpolymer include 1-butene, 1-pentene, 1-hexene, 1-octene and styrene; $\alpha,\omega$-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof.

More complex polymer backbones, often designated as interpolymers, may be prepared using a third component. The third component generally used to prepare an interpolymer backbone is a polyene monomer selected from non-conjugated dienes and trienes. The-non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norborene, 1,5-heptadiene, and 1,6-octadiene. A mixture of more than one diene can be used in the preparation of the interpolymer. A preferred non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer backbone are 1-isopropylidene-3$\alpha$,4,7,7$\alpha$-tetrahydroindene, 1-isopropylidenedicyclopentadiene, dihydro-isodicyclopentadiene, and 2-(2-methylene-4-methyl-3-pentenyl)[2.2.1]bicyclo-5-heptene.

Ethylene-propylene or higher alpha-olefin copolymers may consist of from about 15 to 80 mole percent ethylene and from about 85 to 20 mole percent $C_3$ to $C_{23}$ alpha-olefin with the preferred mole ratios being from about 35 to 75 mole percent ethylene and from about 65 to 25 mole percent of a $C_3$ to $C_{23}$ alpha-olefin, with the more preferred proportions being from 50 to 70 mole percent ethylene and 50 to 30 mole percent $C_3$ to $C_{23}$ alpha-olefin, and the most preferred proportions being from 55 to 65 mole percent ethylene and 45 to 35 mole percent $C_3$ to $C_{23}$ alpha-olefin.

Terpolymer variations of the foregoing polymers may contains from about 0.1 to 10 mole percent of a non-conjugated diene or triene.

The polymer backbone, that is the ethylene copolymer or terpolymer, is an oil-soluble, linear or branched polymer having a number average molecular weight from about 20,000 to 100,000 as determined by gel permeation chromatography and universal calibration standardization, with a preferred number average molecular weight range of 40,000 to 80,000.

The polymerization reaction used to form the ethylene-olefin copolymer backbone is generally carried out in the presence of a conventional Ziegler-Natta or metallocene catalyst system. The polymerization medium is not specific and can include solution, slurry, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffins having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

An ethylenically unsaturated carboxylic acid material is next grafted onto the prescribed polymer backbone to form an acylated ethylene copolymer. These carboxylic reactants which are suitable for grafting onto the ethylene copolymer contain at least one ethylenic bond and at least one, preferably two, carboxylic acid or its anhydride groups or a polar group which is convertible into said carboxyl groups by oxidation or hydrolysis. Preferably, the carboxylic reactants are selected from the group consisting of acrylic, methacrylic, cinnamic, crotonic, maleic, fumaric and itaconic reactants. More preferably, the carboxylic reactants are selected from the group consisting of maleic acid, fumaric acid, maleic anhydride, or a mixture of two or more of these. Maleic anhydride or a derivative thereof is generally most preferred due to its commercial availability and ease of reaction. In the case of unsaturated ethylene copolymers or terpolymers, itaconic acid or its anhydride is preferred due to its reduced tendency to form a cross-linked structure during the free-radical grafting process.

The ethylenically unsaturated carboxylic acid materials typically can provide one or two carboxylic groups per mole of reactant to the grafted polymer. That is, methyl methacrylate can provide one carboxylic group per molecule to the grafted polymer while maleic anhydride can provide two carboxylic groups per molecule to the grafted polymer.

The carboxylic reactant is grafted onto the prescribed polymer backbone in an amount to provide 0.15 to 1.0 carboxylic groups per 1000 number average molecular weight units of the polymer backbone, preferably 0.25 to 0.5 carboxylic groups per 1000 number average molecular weight. For example, a copolymer substrate with Number average molecular weight of 20,000 is grafted with 3 to 20 carboxylic groups per polymer. A copolymer with a number average molecular weight of 100,000 is grafted with 15 to 100 carboxylic groups per polymer chain.

The grafting reaction to form the acylated olefin copolymers is generally carried out with the aid of a free-radical initiator either in solution or in bulk, as in an extruder or intensive mixing device. When the polymerization is carried out in hexane solution, it is economically convenient to carry out the grafting reaction in hexane as described in U.S. Pat. Nos. 4,340,689, 4,670,515 and 4,948,842, incorporated herein by reference. The resulting polymer intermediate is characterized by having carboxylic acid acylating functionality randomly within its structure.

In the bulk process for forming the acylated olefin copolymers, the olefin copolymer is fed to rubber or plastic processing equipment such as an extruder, intensive mixer or masticator, heated to a temperature of 150° to 400° C. and the ethylenically unsaturated carboxylic acid reagent and free-radical initiator are separately co-fed to the molten polymer to effect grafting. The reaction is carried out optionally with mixing conditions to effect shearing and grafting of the ethylene copolymers according to U.S. Pat. No. 5,075,383, incorporated herein by reference. The processing equipment is generally purged with nitrogen to prevent oxidation of the polymer and to aid in venting unreacted reagents and byproducts of the grafting reaction. The residence time in the processing equipment is sufficient to provide for the desired degree of acylation and to allow for purification of the acylated copolymer via venting. Mineral or synthetic lubricating oil may optionally be added to the processing equipment after the venting stage to dissolve the acylated copolymer.

The free-radical initiators which may be used to graft the ethylenically unsaturated carboxylic acid material to the polymer backbone include peroxides, hydroperoxides, peresters, and also azo compounds and preferably those which have a boiling point greater than 100° C. and decompose thermally within the grafting temperature range to provide free radicals. Representatives of these free-radical initiators are azobutyronitrile, dicumyl peroxide, 2,5-dimethylhexane-2,5-bis-tertiarybutyl peroxide and 2,5-dimethylhex-3-yne-2,5-bis-tertiary-butyl peroxide. The initiator is used in an amount of between about 0.005% and about 1% by weight based on the weight of the reaction mixture.

Other methods known in the art for effecting reaction of ethylene-olefin copolymers with ethylenically unsaturated carboxylic reagents, such as halogenation reactions, thermal or "ene" reactions or mixtures thereof, can be used instead of the free-radical grafting process. Such reactions are conveniently carried out in mineral oil or bulk by heating the reactants at temperatures of 250° to 400° C. under an inert atmosphere to avoid the generation of free radicals and oxidation byproducts. "Ene" reactions are a preferred method of grafting when the ethylene-olefin copolymer contains unsaturation. To achieve the high graft levels, 0.15 to 1.0 carboxylic groups per 1000 number average molecular weight, it may be necessary to follow or proceed the "ene" or thermal graft reaction with a free radical graft reaction.

The polymer intermediate possessing carboxylic acid acylating functions is then reacted with a polyamine compound selected from the group consisting of:

(a) an N-arylphenylenediamine represented by the formula:

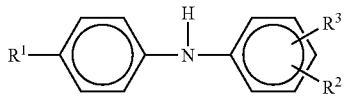

in which $R^1$ is hydrogen, —NH-aryl, —NH-arylalkyl, —NH-alkyl, or a branched or straight chain radical having from 4 to 24 carbon atoms that can be alkyl, alkenyl, alkoxyl, aralkyl, alkaryl, hydroxyalkyl or aminoalkyl; $R^2$ is $—NH_2$, $CH_2—(CH_2)_n—NH_2$, $CH_2$-aryl-$NH_2$, in which n has a value from 1 to 10; and $R^3$ is hydrogen, alkyl, alkenyl, alkoxyl, aralkyl, alkaryl having from 4 to 24 carbon atoms;

(b) an aminothiazole from the group consisting of aminothiazole, aminobenzothiazole, aminobenzothiadiazole and aminoalkylthiazole;

(c) an aminocarbazole represented by the formula:

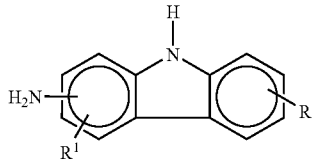

in which R and $R^1$ represent hydrogen or an alkyl, alkenyl, or alkoxy radical having from 1 to 14 carbon atoms;

(d) an aminoindole represented by the formula:

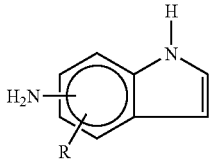

in which R represents hydrogen or an alkyl radical having from 1 to 14 carbon atoms;

(e) an aminopyrrole represented by the formula:

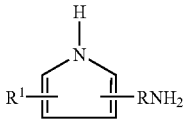

in which R is a divalent alkylene radical having 2 to 6 carbon atoms and $R^1$ is hydrogen or an alkyl radical having from 1 to 14 carbon atoms;

(f) an amino-indazolinone represented by the formula:

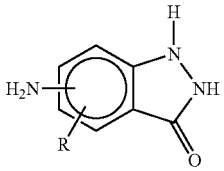

in which R is hydrogen or an alkyl radical having from 1 to 14 carbon atoms;

(g) an aminomercaptotriazole represented by the formula:

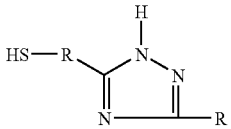

in which R can be absent or is a $C_1$–$C_{10}$ linear or branched hydrocarbon selected from the group consisting of alkyl, alkenyl, arylalkyl, or aryl;

(h) an aminoperimidine represented by the formula:

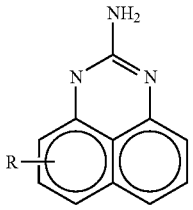

in which R represents hydrogen or an alkyl or alkoxyl radical having from 1 to 14 carbon atoms;

(i) aminoalkyl imidazoles, such as 1-(2-aminoethyl)imidazole, 1-(3-aminopropyl)imidazole; and (j) anminoalkyl morpholines, such as 4-(3-aminopropyl) morpholine.

Particularly preferred polyamines for use in the present invention are the N-arylphenylenediamines, more specifically the N-phenylphenylenediamines, for example, N-phenyl-1,4-phenylenediamine, N-phenyl-1,3-phenylendiamine, and N-phenyl-1,2-phenylenediamine.

It is preferred that the polyamines contain only one primary amine group so as to avoid coupling and/or gelling of the olefin copolymers.

The reaction between the polymer substrate intermediate having grafted thereon carboxylic acid acylating function and the prescribed polyamine compound is preferably conducted by heating a solution of the polymer substrate under inert conditions and then adding the polyamine compound to the heated solution generally with mixing to effect the reaction. It is convenient to employ an oil solution of the polymer substrate heated to 140° to 175° C., while maintaining the solution under a nitrogen blanket. The polyamine compound is added to this solution and the reaction is effected under the noted conditions.

Typically, the polyamine compound(s) is (are) dissolved in a surfactant and added to a mineral or synthetic lubricating oil or solvent solution containing the acylated olefin copolymer. This solution is heated with agitation under an inert gas purge at a temperature in the range of 120° to 200° C. as described in U.S. Pat. No. 5,384,371, the disclosure of which is herein incorporated by reference. The reactions are carried out conveniently in a stirred reactor under nitrogen purge. However, it is also possible to add a surfactant solution of the polyamine compound to zones downstream from the graft reaction-vent zones in a twin screw extruder reactor.

Surfactants which may be used in carrying out the reaction of the acylated olefin copolymer with the polyamine(s) include but are not limited to those characterized as having (a) solubility characteristics compatible with mineral or synthetic lubricating oil, (b) boiling point and vapor pressure characteristics so as not to alter the flash point of the oil and (c) polarity suitable for solubilizing the polyamine(s). A suitable class of such surfactants includes the reaction products of aliphatic and aromatic hydroxy compounds with ethylene oxide, propylene oxide or mixtures thereof. Such surfactants are commonly known as aliphatic or phenolic alkoxylates. Representative examples are SURFONIC® N-40, N-60, L-24-5, L-46-7 (Huntsman Chemical Company), NEODOL® 23-5 and 25-7 (Shell Chemical Company) and TERGITOL® surfactants (Union Carbide). Preferred surfactants include those surfactants that contain a functional group, e.g., —OH, capable of reacting with the acylated olefin copolymer.

The quantity of surfactant used depends in part on its ability to solubilize the polyamine. Typically, concentrations of 5 to 40 wt. % polyamine are employed. The surfactant can also be added separately, instead of or in addition to the concentrates discussed above, such that the total amount of surfactant in the finished additive is 10 wt. % or less.

The highly grafted, multi-functional olefin copolymers can be incorporated into a base oil in any convenient way. Thus, the highly grafted, multi-functional olefin copolymers can be added directly to the base oil by dispersing or dissolving the same in the lubricating oil at the desired level of concentration. Such blending into the base oil can occur at room temperature or elevated temperatures. Alternatively, the highly grafted, multi-functional olefin copolymers can be blended with a suitable oil-soluble solvent/diluent (such as benzene, xylene, toluene, lubricating base oils and petroleum distillates) to form a concentrate, and then blending the concentrate with a lubricating oil to obtain the final formulation. Such additive concentrates will typically contain (on an active ingredient (A.I.) basis) from about 3 to about 45 wt. %, and preferably from about 10 to about 35 wt. %, highly grafted, multi-functional olefin copolymer additive, and typically from about 20 to 90 wt %, preferably from about 40 to 60 wt %, base oil based on the concentrate weight.

In the preparation of lubricating oil formulations it is common practice to introduce the additives in the form of 10 to 80 wt. % active ingredient concentrates in hydrocarbon oil, e.g. mineral lubricating oil, or other suitable solvent. Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend. Thus, the highly grafted, multi-functional olefin copolymer would usually be employed in the form of a 10 to 50 wt. % concentrate, for example, in a lubricating oil fraction.

The highly grafted, multi-functional olefin copolymers may be post-treated so as to impart additional properties necessary or desired for a specific lubricant application. Post-treatment techniques are well known in the art and include boronation, phosphorylation, and maleination.

At numerous places throughout this specification, reference has been made to a number of U.S. patents. All such cited documents are expressly incorporated in full into this disclosure as if fully set forth herein.

The patentees do not intend to dedicate any disclosed embodiments to the public, and to the extent any disclosed modifications or alterations may not literally fall within the scope of the claims, they are considered to be part of the invention under the doctrine of equivalents.

This invention is susceptible to considerable variation in its practice. Accordingly, this invention is not limited to the specific exemplifications set forth hereinabove. Rather, this invention is within the spirit and scope of the appended claims, including the equivalents available as a matter of law.

What is claimed is:

1. A crankcase lubricating system for a motor vehicle comprising, a filterless lubricant circulation system, and a crankcase lubricant containing a fully formulated lubricating oil meeting or exceeding ILSAC GF-4 or API CI-4 minimum performance standards for engine oils, wherein the crankcase lubricant comprises a nitrogen containing olefin copolymer derived from a copolymer having grafted thereon from about 0.15 to about 1.0 carboxylic groups per 1000 number average molecular weight units of the copolymer.

2. The lubricating system of claim 1, wherein the olefin copolymer has a number average molecular weight ranging from about 20,000 to about 100,000.

3. The lubricating system of claim 1, further comprising a lubricant circulation pump.

4. The lubricating system of claim 1, wherein the lubricating system comprises an automobile lubricating system.

5. The lubricating system of claim 1, wherein the lubricating system comprises a tractor-trailer lubricating system.

6. The lubricating system of claim 1, wherein the lubricating system comprises a crankcase lubricating system for a spark-ignition engine.

7. The lubricating system of claim 1, wherein the lubricating system comprises a crankcase lubricating system for a compression-ignition engine.

8. A motor vehicle comprising the lubricating system of claim 1.

9. An automobile comprising the lubricating system of claim 1.

10. A tractor-trailer rig comprising the lubricating system of claim 1.

11. A method of lubricating moving parts of a fuel combustion engine having separate fuel and lubricant systems, the method comprising the steps of:

providing a crankcase lubricating system containing a lubricant circulation device, wherein the crankcase lubricating system is devoid of a lubricant filter; and circulating in the crankcase lubricating system a lubricant meeting or exceeding ILSAC GF-4 or API CI-4 standards for engine oils, wherein the lubricant comprises a nitrogen containing olefin copolymer having grafted thereon from about 0.15 to about 1.0 carboxylic groups per 1000 number average molecular weight units of the copolymer.

12. The method of claim 11, wherein the copolymer has a number average molecular weight ranging from about 20,000 to about 100,000.

13. The method of claim 11, wherein the fuel combustion engine comprises a spark-ignition engine of a passenger automobile.

14. The method of claim 11, wherein the fuel combustion engine comprises a compression-ignition engine of a passenger automobile.

15. The method of claim 11, wherein the fuel combustion engine comprises a compression-ignition engine of a tractor-trailer rig.

16. A method for reducing maintenance costs for a motor vehicle comprising providing an engine and a crankcase lubricating system for the engine, removing an oil filter from an oil filter location for the crankcase lubricating system, attaching a substantially permanent bypass device to the oil filter location, and circulating, in the crankcase lubricating system, a lubricant meeting or exceeding ILSAC GF-4 or API CI-4 minimum performance standards for engine oils.

17. The method of claim 16, wherein the lubricant contains a lubricating base oil and a lubricant additive, the lubricant additive including a nitrogen containing olefin copolymer having grafted thereon from about 0.15 to about 1.0 carboxylic groups per 1000 number average molecular weight units of the copolymer, wherein the copolymer has a number average molecular weight ranging from about 20,000 to about 100,000.

18. The method of claim 16, wherein the motor vehicle comprises a passenger automobile containing a spark-ignition engine.

19. The method of claim 16, wherein the motor vehicle comprises a passenger automobile containing a compression-ignition engine.

20. The method of claim 16, wherein the motor vehicle comprises a tractor-trailer rig containing a compression-ignition engine.

21. A crankcase lubricating system for a motor vehicle comprising, a lubricant circulation system having an absence of a filtering means for the lubricant, optionally, a lubricant circulation pump, and a crankcase lubricant containing a fully formulated lubricating base oil meeting or exceeding ILSAC GF-4 or API CI-4 minimum performance standards for engine oils, wherein the crankcase lubricant comprises a nitrogen containing olefin copolymer having grafted thereon from about 0.15 to about 1.0 carboxylic groups per 1000 number average molecular weight units of the copolymer.

22. The lubricating system of claim 21, wherein the olefin copolymer has a number average molecular weight ranging from about 20,000 to about 100,000.

23. The lubricating system of claim 21, wherein the lubricating system comprises an automobile lubricating system.

24. The lubricating system of claim 21, wherein the lubricating system comprises a tractor-trailer lubricating system.

25. The lubricating system of claim 21, wherein the lubricating system comprises a crankcase lubricating system for a spark-ignition engine.

26. The lubricating system of claim 21, wherein the lubricating system comprises a crankcase lubricating system for a compression-ignition engine.

27. A motor vehicle comprising the lubricating system of claim 21.

28. An automobile comprising the lubricating system of claim 21.

29. A tractor-trailer rig comprising the lubricating system of claim 21.

30. A crankcase lubricating system for a motor vehicle comprising, a lubricant circulation system having an absence of an externally removable filtering means for the lubricant, optionally, a lubricant circulation pump, and a crankcase lubricant containing a fully formulated lubricating base oil meeting or exceeding ILSAC GF-4 or API CI-4 minimum performance standards for engine oils, wherein the crankcase lubricant comprises a nitrogen containing olefin copolymer having grafted thereon from about 0.15 to about 1.0 carboxylic groups per 1000 number average molecular weight units of the copolymer.

31. The lubricating system of claim 30, wherein the olefin copolymer has a number average molecular weight ranging from about 20,000 to about 100,000.

32. The lubricating system of claim 30, wherein the lubricating system comprises an automobile lubricating system.

33. The lubricating system of claim 30, wherein the lubricating system comprises a tractor-trailer lubricating system.

34. The lubricating system of claim 30, wherein the lubricating system comprises a crankcase lubricating system for a spark-ignition engine.

35. The lubricating system of claim 30, wherein the lubricating system comprises a crankcase lubricating system for a compression-ignition engine.

36. A motor vehicle comprising the lubricating system of claim 30.

37. An automobile comprising the lubricating system of claim 30.

38. A tractor-trailer rig comprising the lubricating system of claim 30.

39. A method of operating a filterless motor vehicle having a fuel combustion engine and a crankcase comprising the steps of:

providing a crankcase lubricating system for the fuel combustion engine of the motor vehicle, the crankcase lubricating system containing a lubricant circulation device, wherein the crankcase lubricating system is devoid of a lubricant filter; and circulating in the crankcase lubricating system a lubricant meeting or exceeding ILSAC GF-4 or API CI-4 standards for engine oils, wherein the lubricant comprises a nitrogen containing olefin copolymer having grafted thereon from about 0.15 to about 1.0 carboxylic groups per 1000 number average molecular weight units of the copolymer.

40. The method of claim 39, wherein the olefin copolymer has a number average molecular weight ranging from about 20,000 to about 100,000.

41. The method of claim 39, wherein the fuel combustion engine comprises a spark-ignition engine.

42. The method of claim 39, wherein the fuel combustion engine comprises a compression-ignition engine.

43. The method of claim 39, wherein the lubricant filter comprises an externally removable lubricant filter.

44. The method of claim 39, wherein the lubricant filter comprises an internal lubricant filter.

* * * * *